US006117502A

United States Patent [19]

Liao

[11] Patent Number: 6,117,502

[45] Date of Patent: Sep. 12, 2000

[54] TRANSPARENT STRUCTURE WITH A DECORATION THEREIN

[76] Inventor: Chu-Yuan Liao, 5F-1, No. 177 Sec. 1 Ho-Ping E. Rd., Taipei, Taiwan

[21] Appl. No.: 09/263,087

[22] Filed: Mar. 8, 1999

[30] Foreign Application Priority Data

Jul. 28, 1998 [TW] Taiwan ..... 87212194

[51] Int. Cl.[7] ..... A47G 1/12

[52] U.S. Cl. ..... 428/13; 428/12; 428/14; 428/34.1; 428/542.2; 446/74; 446/267; 40/406; 40/407

[58] Field of Search ..... 428/12, 13, 14, 428/34.1, 542.2, 34.3, 913.3; 40/406, 407, 409, 412; 446/267, 74, 73; 206/457

[56] References Cited

U.S. PATENT DOCUMENTS

| | | | |
|---|---|---|---|
| 5,292,564 | 3/1994 | Lee | 428/13 |
| 5,329,714 | 7/1994 | Lee | 40/409 |
| 5,378,513 | 1/1995 | Lee | 428/13 |
| 5,476,406 | 12/1995 | Cheng | 446/267 |
| 5,503,274 | 4/1996 | Toffler et al. | 206/457 |
| 5,985,379 | 11/1999 | Longsdorf | 428/13 |
| 5,989,655 | 11/1999 | Meng | 428/13 |
| 6,001,433 | 12/1999 | Meng | 428/13 |

*Primary Examiner*—Deborah Jones
*Assistant Examiner*—Abraham Bahta
*Attorney, Agent, or Firm*—Dougherty & Troxell

[57] ABSTRACT

A transparent structure with a decoration therein, including a transparent membrane, a bottom seat, a top cap, a fastening belt, a buoyant decoration and a liquid. The transparent membrane is made of a thermoplastic plastic material or the like. A user can watch or touch the buoyant decoration through the transparent membrane. The transparent membrane has simple structure and can be squeezed or compressed without breaking.

14 Claims, 5 Drawing Sheets

TRANSPARENT STRUCTURE WITH A DECORATION THEREIN

BACKGROUND OF THE INVENTION

The present invention relates to an improved transparent structure with a decoration therein. A transparent membrane is formed into a hollow tubular body in which a liquid mixed with golden powders or chips or buoyant decorations is filled. When shaking or swinging the transparent body, the liquid is stirred and the buoyant decorations and the golden powders or chips buoy through the liquid. A user not only can watch the buoyant decoration through the transparent membrane, but also can squeeze the transparent membrane to touch the content therein. This provides another novel aspect of the transparent container to increase the entertaining effect. The transparent membrane is made of flexible plastic material and is specifically assembled with other components and thus can be squeezed or compressed without breaking and leaking of the liquid.

Various kinds of transparent containers with decorations therein are commercially available. In all these transparent containers, it is impossible for the user to touch the decoration inside the container unless the decoration is taken out from the container. The conventional transparent container is made of rigid solid material which can be hardly varied in pattern after formed. Therefore, such solid container has monotonous appearance and can only provide visual entertaining effect and it is impossible for a user to touch the buoyant decoration contained therein.

SUMMARY OF THE INVENTION

It is a primary object of the present invention to provide an improved transparent structure with a decoration therein. The transparent structure is made of a transparent membrane made of soft plastic material or the like and formed into a hollow tubular container in which a liquid and buoyant decorations are filled. A user not only can watch the buoyant decoration through the transparent membrane, but also can squeeze the transparent membrane to touch the content therein.

According to the above object, the transparent structure with a decoration therein of the present invention includes a transparent membrane, a bottom seat, a top cap, a fastening belt, a buoyant decoration and a liquid. The transparent membrane is made of a thermoplastic plastic material or the like and is specifically assembled with other components and thus can be squeezed or compressed without breaking or leaking.

The present invention can be best understood through the following description and accompanying drawings, wherein:

DETAILED DESCRIPTION OF THE PREFERRED EMBODIMENTS

Figure 1:
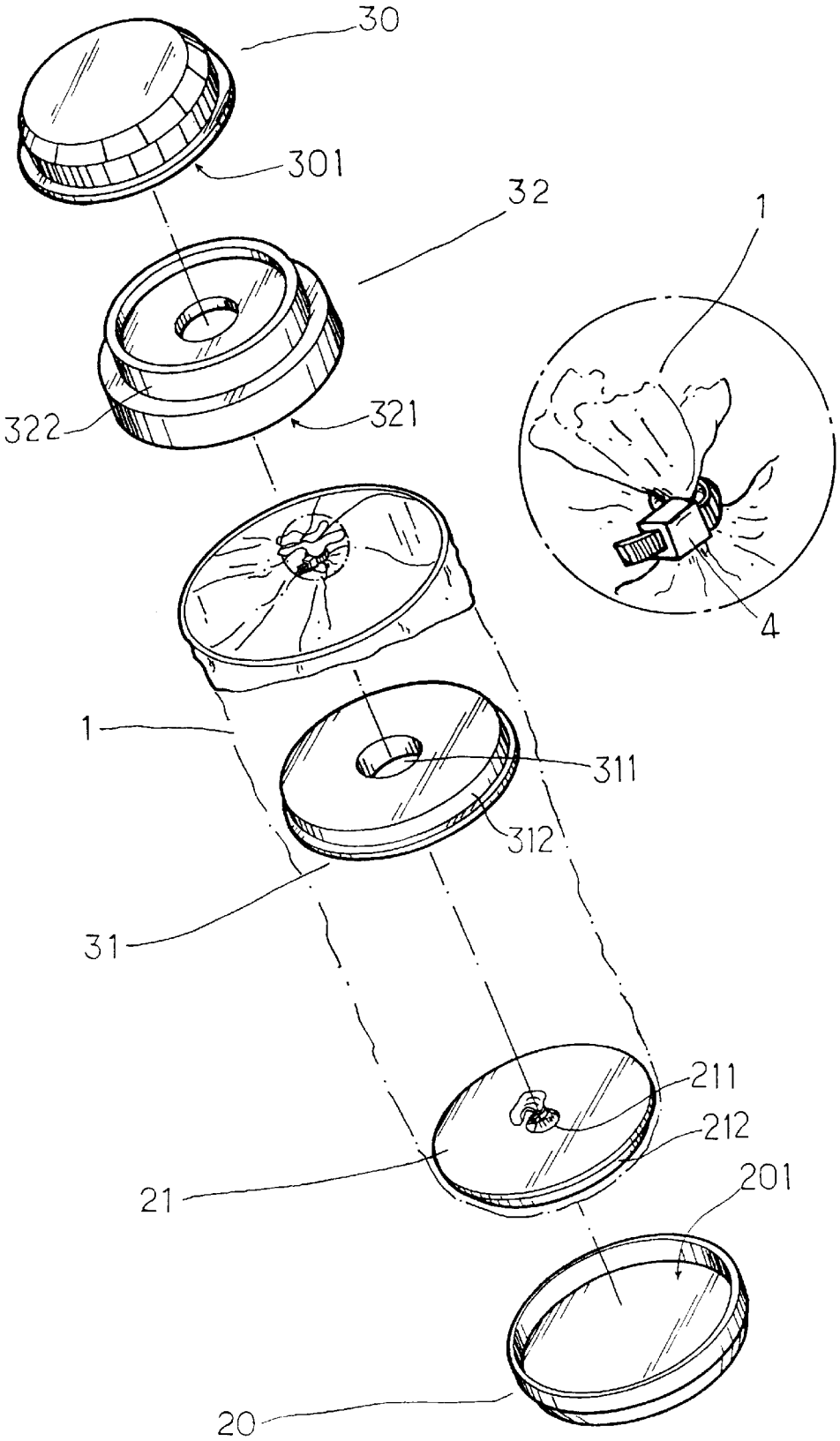
FIG. 1 is a perspective exploded view of the present invention.
Figure 2:
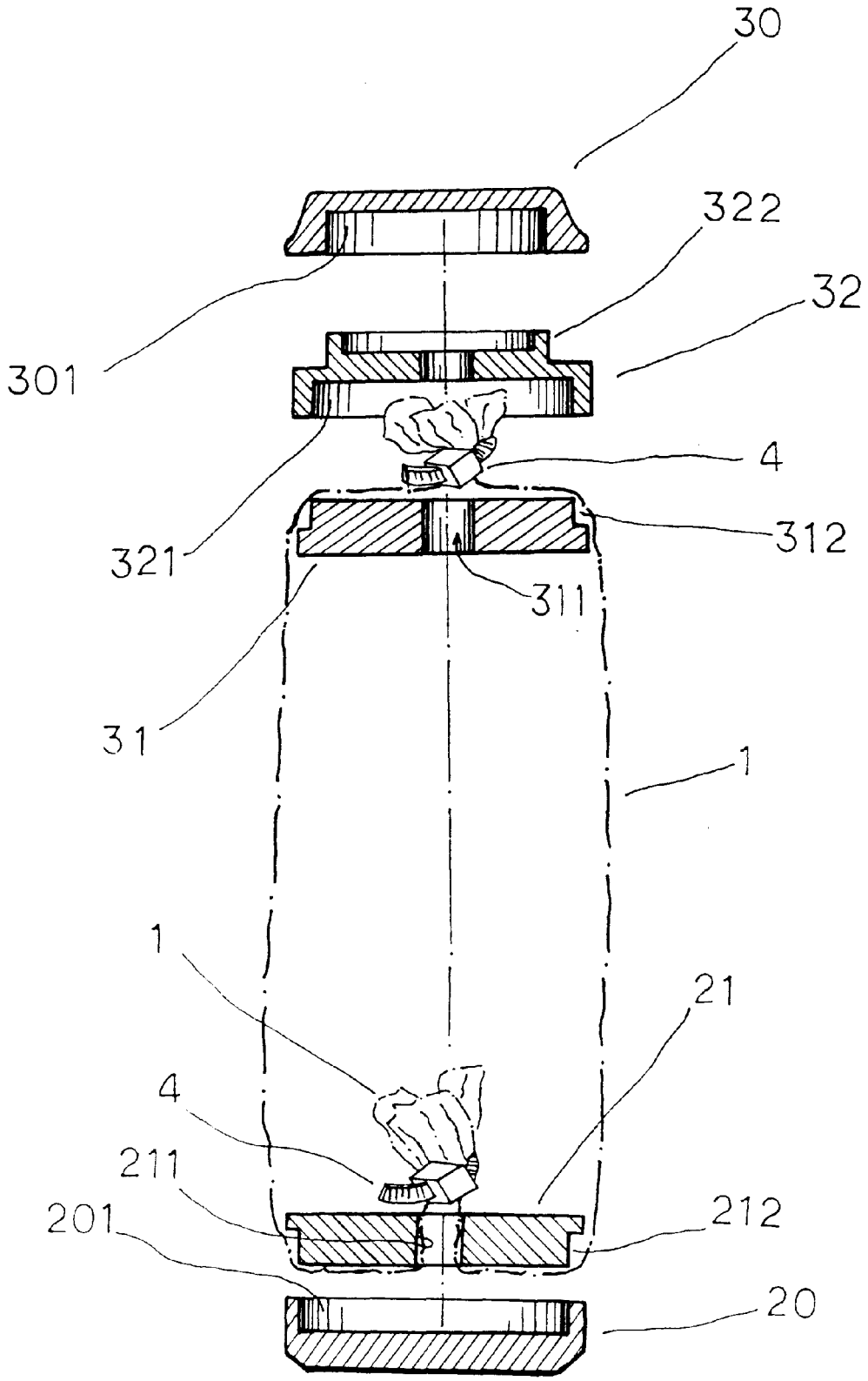
FIG. 2 is a side sectional exploded view of the present invention.
Figure 3:
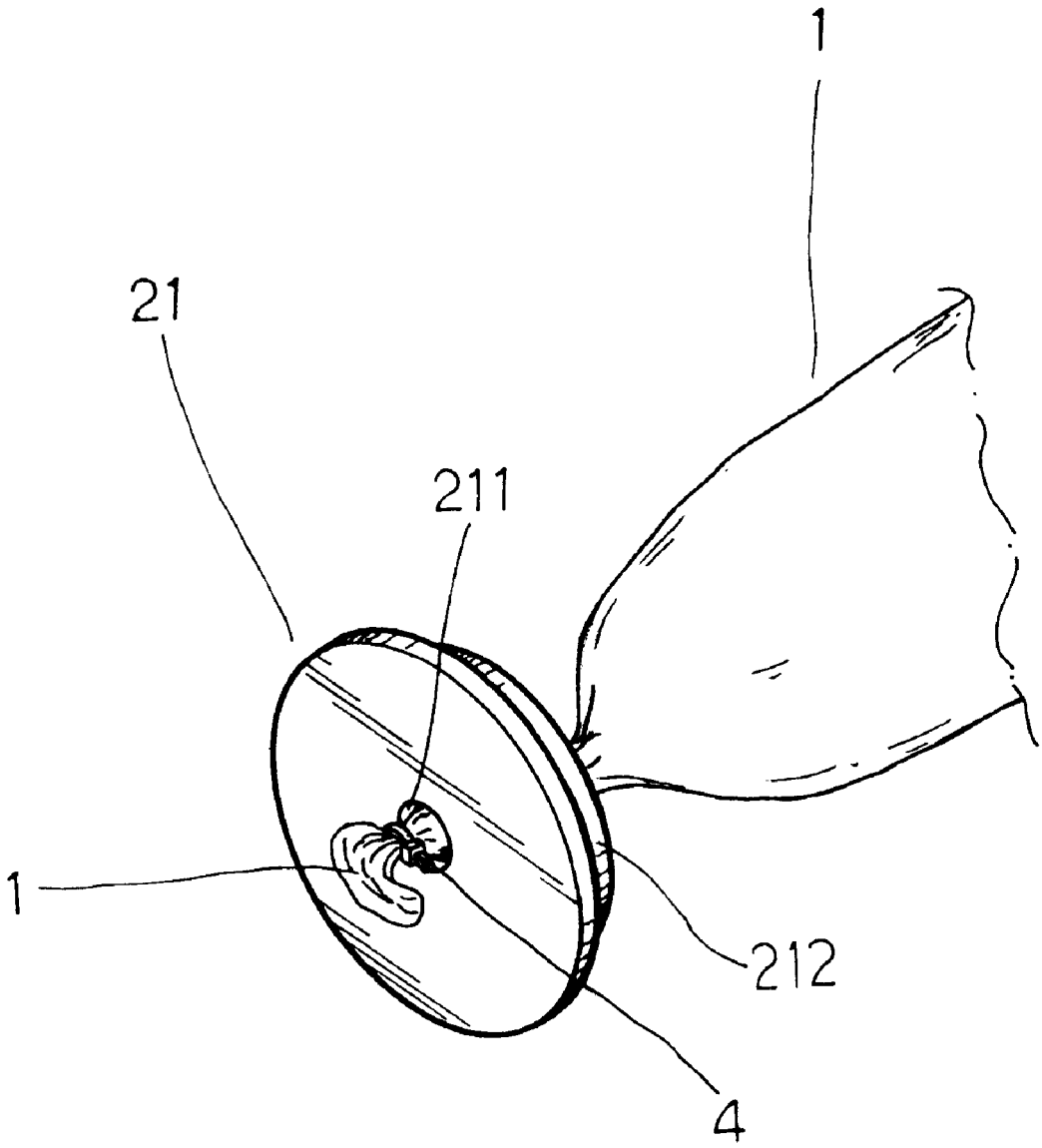
FIG. 3 shows that an open end of the transparent membrane is passed through the central hole of the bottom seat and tied up by the fastening belt.

Please refer to FIG. 1. The present invention includes a transparent membrane 1, a bottom seat 2, a top cap 3, a fastening belt 4, a buoyant decoration 5 and a liquid 6. The transparent membrane 1 is made of a soft plastic material or the like (such as emulsion ). The transparent membrane 1 has a form of hollow tube which is able to bear tearing force without departure. FIG. 2 shows a sectional assembled view of the present invention. The bottom seat 2 is composed of a bottom cover 20 and a bottom connector 21. The bottom cover 20 is formed with a recessed fitting section 201. The bottom connector 21 is disposed with an annular section 212 along the circumference of the bottom connector 21 corresponding to the fitting section 201. The bottom connector is formed with a central hole 211. The top cap 3 is composed of a top cover 30, a pressing cover 31 and a top connector 32 sandwiched therebetween. The top cover 30 is formed with a recessed fitting section 301 and the pressing cover 31 is formed with a central through hole 311 and an annular section 312 facing the top connector 32. The top connector 32 is formed with a recessed fitting section 321 corresponding to the annular section 312 and an annular section 322 corresponding to the fitting section 301 of the top cover 30. Please refer to FIGS. 1 to 3. An open end of the transparent membrane 1 is passed through the central hole 211 of the bottom connector 21 from the annular section 212 and then the open end is tied up by the fastening belt 4 and restricted to one end opposite to the annular section 212. Then the other end of the transparent membrane 1 is reversely outward folded to wrap the bottom connector 21 so that the bottom connector 21 is reversely positioned in the transparent membrane 1. Then the pressing cover 31 is placed into the transparent membrane 1 from the other open end of the transparent membrane 1 and the open end is tied up by another fastening belt 4. Then the fitting section 201 of the bottom cover 20 is tightly fitted around the annular section 212 of the bottom connector 21 in the transparent membrane 1 to seal the end of the transparent membrane 1. The fitting section 321 of the top connector 32 is fitted with the annular section 312 of the pressing cover 31 in the transparent membrane 1. The fitting section 301 of the top cover 30 is tightly fitted with the annular section 322 of the top connector 32 to seal the end of the transparent membrane so as to prevent the liquid 6 from leaking outside and avoid breaking of the connection.

Figure 4:
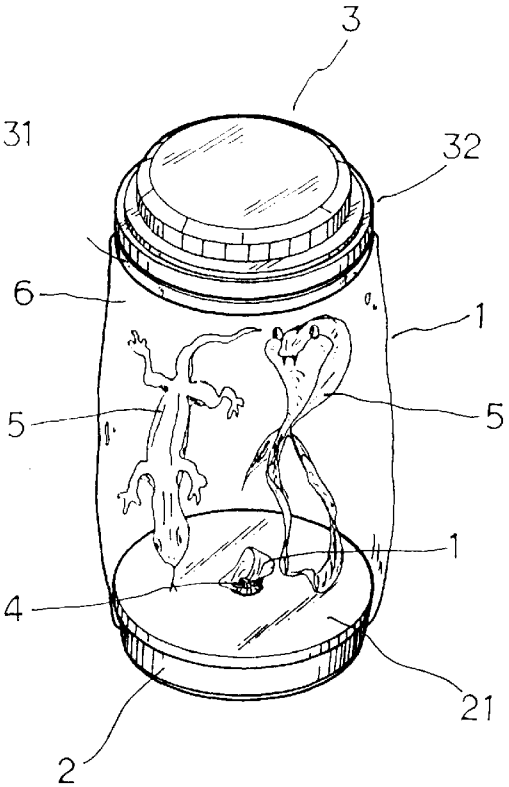
FIG. 4 shows an embodiment of the present invention.

Please refer to FIG. 4. Before the pressing cover 31 is placed into the transparent membrane 1, the liquid 6 and the buoyant decoration 5 are filled thereinto. Then the pressing cover 31 is placed into the transparent membrane 1 and the open end thereof is tied up by the fastening belt 4. Then the top connector 32, top cover 30 and the bottom cover 20 are fitted therewith so as to more tightly associate the transparent membrane 1 with the bottom seat 2 and the top cap 3. Each end of the transparent membrane 1 has at least two water-sealing structures (fastening and pressing), so that the liquid 6 contained in the transparent membrane 1 will not leak outside due to breaking of the transparent membrane 1 by squeezing or touching. This improves the problems of fixed pattern and easy breaking of the conventional transparent container.

Figure 5:
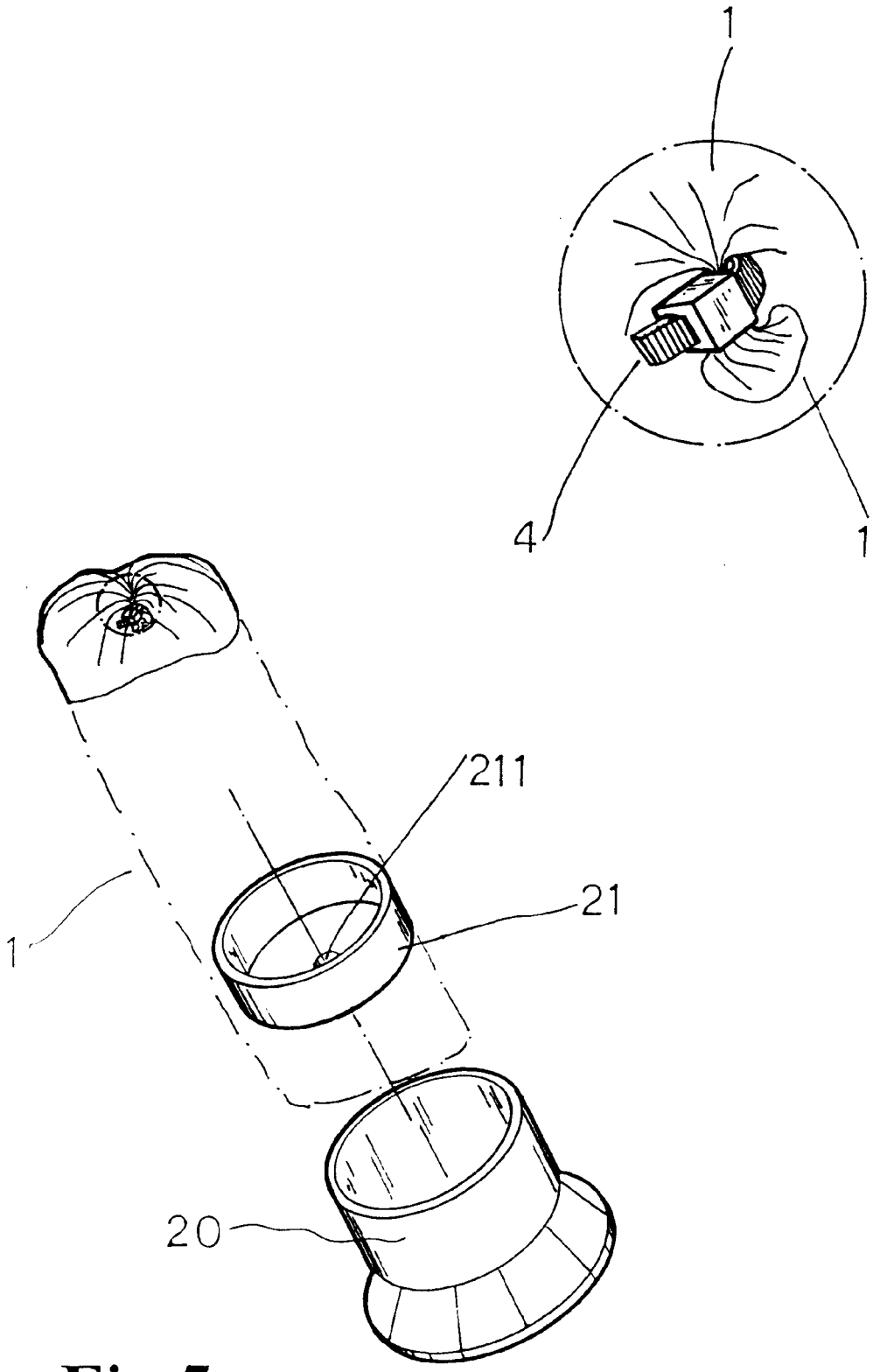
FIG. 5 is a perspective exploded view of another embodiment of the present invention.

Please refer to FIG. 5. An open end of the transparent membrane 1 is first tied up by the fastening belt 4. Then the other end of the transparent membrane 1 is reversely outward folded to enclose the fastening belt 4 in the transparent membrane 1. The bottom connector 21 is placed into the transparent membrane 1 from the other open end which is tied up by the fastening belt 4. Then the bottom cover 20 is fitted with the bottom connector 21 in the transparent membrane 1 from outer side of the transparent membrane 1 to form another aspect of buoyant decoration in the transparent article.

Figure 6:
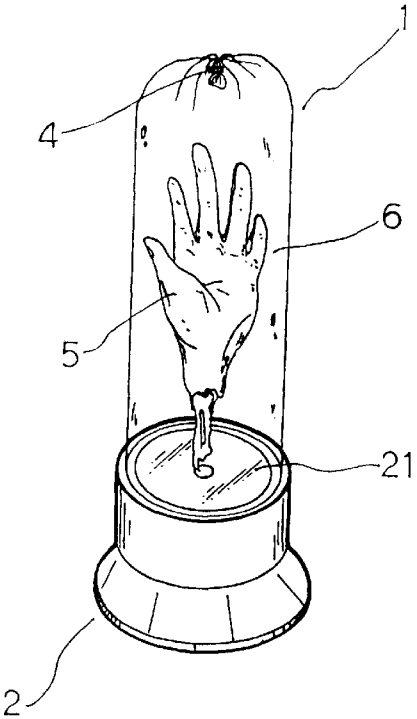
FIG. 6 is a perspective assembled view according to FIG. 5.

Please refer to FIG. 6. Before the bottom connector 21 is placed into the transparent membrane 1, the liquid 6 and the article-simulative buoyant decoration 5 are first filled into the transparent membrane 1. Then the bottom connector 21 is placed into the transparent membrane 1 and the open end of the transparent membrane 1 is tied up by the fastening belt 4. Then the bottom cover 20 is fitted therewith to form another aspect of buoyant decoration in the transparent article.

Figure 7:
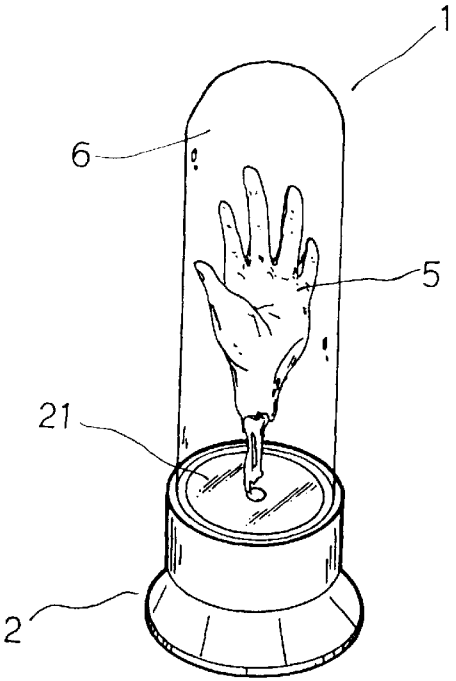
FIG. 7 shows still another embodiment of the present invention.

Please refer to FIG. 7 in which the transparent membrane 1 is different from the above transparent membrane 1 in structure, One end of such transparent membrane 1 is formed as a close end and the other end thereof is an open end which is fitted with and sealed by the bottom connector 21 and the bottom cover 20 to form still another aspect of buoyant decoration in the transparent article.

According to the above arrangement, a user not only can watch the decoration contained in the transparent membrane, but also can squeeze the transparent membrane to touch and feel the decoration contained therein. The ends of the transparent membrane are well sealed without leakage.

It should be noted that the above description and accompanying drawings are only used to illustrate some embodiments of the present invention, not intended to limit the scope thereof. Any modification of the embodiments should fall within the scope of the present invention.

What is claimed is:

1. A transparent structure with a decoration therein, comprising a transparent membrane, a bottom seat, a top cap, a fastening belt, a buoyant decoration and a liquid, the transparent membrane being made of a soft plastic material and having a form of hollow tube, the bottom seat being composed of a bottom cover and a bottom connector, the bottom connector being formed with a central hole, one end of the transparent membrane being passed through the central hole and tied up, the other end thereof extending between the bottom cover and bottom connector and sealedly clamped thereby to form an outward extending section which extends to the other end to associate with the top cap, the top cap being composed of a top cover, a pressing cover and a top connector, the top connector being sandwiched between the top cover and the pressing cover, the end of the transparent membrane wrapping the pressing cover and tied up by the fastening belt between the pressing cover and the top connector, the tied end being sealedly pressed between the pressing cover and the top connector, whereby the liquid and the buoyant decoration are filled into the transparent membrane to form a soft container for watching and touching the decoration.

2. A transparent structure with a decoration therein as claimed in claim 1, wherein the bottom cover is formed with a recessed fitting section and the bottom connector is disposed with an annular section along the circumference of the bottom connector corresponding to the fitting section for fitting with the same.

3. A transparent structure with a decoration therein as claimed in claim 1, wherein a top cover is fitted around the top connector.

4. A transparent structure with a decoration therein as claimed in claim 3, wherein the top connector and the top cover are integrally formed.

5. A transparent structure with a decoration therein as claimed in claim 1, wherein the pressing cover is formed with an annular section facing the top connector and the top connector is formed with a recessed fitting section corresponding to the annular section for fitting with the same.

6. A transparent structure with a decoration therein as claimed in claim 2, wherein the pressing cover is formed with an annular section facing the top connector and the top connector is formed with a recessed fitting section corresponding to the annular section for fitting with the same.

7. A transparent structure with a decoration therein as claimed in claim 3, wherein the pressing cover is formed with an annular section facing the top connector and the top connector is formed with a recessed fitting section corresponding to the annular section for fitting with the same.

8. A transparent structure with a decoration therein as claimed in claim 4, wherein the pressing cover is formed with an annular section facing the top connector and the top connector is formed with a recessed fitting section corresponding to the annular section for fitting with the same.

9. A transparent structure with a decoration therein as claimed in claim 5, wherein the top connector is formed with an annular section facing the top cover and the top cover is formed with a fitting section corresponding to the annular section for fitting with the same.

10. A transparent structure with a decoration therein as claimed in claim 6, wherein the pressing cover is formed with an annular section facing the top connector and the top connector is formed with a recessed fitting section corresponding to the annular section for fitting with the same.

11. A transparent structure with a decoration therein as claimed in claim 7, wherein the pressing cover is formed with an annular section facing the top connector and the top connector is formed with a recessed fitting section corresponding to the annular section for fitting with the same.

12. A transparent structure with a decoration therein as claimed in claim 8, wherein the pressing cover is formed with an annular section facing the top connector and the top connector is formed with a recessed fitting section corresponding to the annular section for fitting with the same.

13. A transparent structure with a decoration therein, comprising a transparent membrane, a bottom seat, a buoyant decoration and a liquid, the transparent membrane being made of a soft plastic material and having a form of hollow tube with one single open end, the bottom seat being composed of a bottom cover and a bottom connector, the bottom connector being formed with a central hole, the open end of the transparent membrane being passed through the central hole and tied up, the other end thereof extending between the bottom cover and bottom connector and sealedly clamped thereby to form an outward extending section which extends to the other end to be sealed, the liquid and the buoyant decoration being filled into the transparent membrane to form a soft container for watching and touching the decoration.

14. A transparent structure with a decoration therein as claimed in claim 13, wherein the bottom cover is formed with a recessed fitting section and the bottom connector is disposed with an annular section along the circumference of the bottom connector corresponding to the fitting section for fitting with the same.

* * * * *